US006844802B2

(12) United States Patent
Drummond et al.

(10) Patent No.: US 6,844,802 B2
(45) Date of Patent: Jan. 18, 2005

(54) PARALLEL CORE ELECTROMAGNETIC DEVICE

(75) Inventors: Geoffrey N. Drummond, Fort Collins, CO (US); Shane A. Lloyd, Eaton, CO (US)

(73) Assignee: Advanced Energy Industries, Inc., Fort Collins, CO (US)

( * ) Notice: Subject to any disclaimer, the term of this patent is extended or adjusted under 35 U.S.C. 154(b) by 57 days.

(21) Appl. No.: 10/464,138

(22) Filed: Jun. 18, 2003

(65) Prior Publication Data

US 2004/0257187 A1 Dec. 23, 2004

(51) Int. Cl.[7] ..... H01F 27/08
(52) U.S. Cl. ..... 336/61; 336/5; 336/55
(58) Field of Search ..... 336/5, 55, 61, 336/57, 65

(56) References Cited

U.S. PATENT DOCUMENTS

| | | | | |
|---|---|---|---|---|
| 4,613,841 A | | 9/1986 | Roberts | |
| 4,845,606 A | | 7/1989 | Herbert | |
| 5,333,646 A | * | 8/1994 | Delot | 137/827 |
| 5,900,795 A | * | 5/1999 | Holmgren et al. | 336/55 |
| 5,929,737 A | * | 7/1999 | Zinders et al. | 336/155 |
| 5,936,503 A | * | 8/1999 | Holmgren et al. | 336/60 |
| 6,084,499 A | | 7/2000 | Faulk | |
| 6,087,916 A | * | 7/2000 | Kutkut et al. | 336/61 |
| 6,144,276 A | | 11/2000 | Booth | |
| 6,222,733 B1 | | 4/2001 | Gammenthaier | |

FOREIGN PATENT DOCUMENTS

EP 0 860 048 B1 6/2003

OTHER PUBLICATIONS

Mark S. Rauls, et al., Design Considerations for High–Frequency Coaxial Winding Power Transformers. IEEE Transactions on Industry Applications, vol. 29, No. 2, Mar./Apr. 1993, pp. 375–381.
Bendre, Ashish, et al., Design Condsiderations for a Soft–Switched Modular 2.4–MVA Medium–Voltage Dr.

* cited by examiner

*Primary Examiner*—Anh Mai
(74) *Attorney, Agent, or Firm*—John D. Pirnot

(57) ABSTRACT

An electromagnetic device such as a power transformer comprises at least two tubular magnetic core sections spaced apart in substantially parallel alignment. The windings of the device are substantially disposed within each tubular magnetic core. The outer surfaces of the magnetic core sections are essentially unobstructed and available for contact with heat extraction elements. The core sections may be elongated relative to their cross-sectional dimensions in order to increase the cooling surface area. The device configuration accommodates a means of providing for selected values of leakage inductance using opposing projections extending inward from the tubular side walls of the cores. The configuration also accommodates a means of actively adjusting the leakage inductance of the device.

33 Claims, 6 Drawing Sheets

PARALLEL CORE ELECTROMAGNETIC DEVICE

BACKGROUND OF THE INVENTION

1. Field of the Invention

This invention relates generally to the field of electromagnetic devices, and more particularly to cooling of electromagnetic devices such as power transformers.

2. Brief Description of the Prior Art

A basic electrical transformer consists of two or more conductive coils wound around a common magnetic core. When a time-varying voltage is applied across one ("primary") coil, a corresponding time-varying voltage is produced in the other ("secondary") coil through the property of magnetic induction. By adjusting the number of turns in the windings of the secondary coil relative to that of the primary coil (the "turns ratio"), the time-varying voltage induced across the secondary may raised or lowered relative to that of the primary. Transformers are commonly used in power electronics, for example, to convert to the electrical energy provided by a power source to voltage levels required by a particular load.

Because all real coil and core materials have imperfect electrical and magnetic properties, energy is lost and dissipated in the transformer elements in the form of heat. A means for removing this heat is generally required, and particularly when a transformer is located within an enclosure in proximity to other electrical components that may be impaired in their performance or damaged by high temperatures. This problem is particularly acute in power delivery applications, where generation of high currents results in large amounts of dissipated power, and where an increase in the size of transformer elements results in more heat-generating volume in the element relative to the surface area from which heat may be extracted. The problem is further compounded in high frequency applications due to the fact that magnetic core materials suitable for high frequency operation, e.g. ferrites, tend to have relatively poor thermal conductivity, making heat extraction from the material all the more difficult.

A number of approaches have been suggested for improving heat extraction from transformer elements. For example, Rauls, et al., in "Design Considerations for High Frequency Coaxial Winding Power Transformers," IEEE Transactions on Industry Applications, Vol. 29, No. 2, March/April 1993, conclude that a low-loss coaxial transformer design having an aspect ratio that is long and thin results in improved heat transfer due to the increased surface area of the transformer cores. They note, however, that heat extraction from the windings of a coaxial transformer is impeded by the surrounding core material, which is generally of poor thermal conductivity, and propose that heat transfer from coaxial transformers may be enhanced by forcing a coolant through the primary electrical conductor.

U.S. Pat. No. 6,087,916 describes coaxial transformer structures having a heat transfer member in contact with both the outer electrical conductor of the transformer and a heat sink, as well as heat conducting straps in contact with the transformer core surfaces. In this configuration, the heat transfer member includes an electrically insulating component if the heat sink is to remain electrically isolated from the transformer. Bendre, et al., also describe a mechanism for cooling a coaxial power transformer in "Design Considerations for a Soft-Switched Modular 2.4-MVA Medium Voltage Drive," IEEE Transactions on Industry Applications, Vol. 38, No. 5, September/October 2002. There, a coaxial transformer design is illustrated having flat-sided cores that may be placed directly on a baseplate to aid in cooling. To increase further the heat transfer surface area, Bendre et al. suggest that two transformers may be used in a parallel-primary series-secondary configuration.

Another approach to the problem of transformer cooling takes advantage of "planar" transformer designs, wherein the transformer exhibits a reduced height and a correspondingly large footprint area. The windings of a planar transformer may be constructed of flat conductive traces on printed circuit boards, for example, with the resulting transformer profile being very thin and flattened. Thus, the available cooling surface area of a planar transformer may be significantly higher than that of a conventional wire-wound transformer of equivalent volume. In addition, the reduced thickness of the magnetic cores may simplify heat extraction from the core material. At very high power levels, however, the footprint area needed to accommodate a given flux density may become prohibitively large. U.S. Pat. No. 6,222,733 describes a means of improving the cooling of planar transformers using a planar cooling body. U.S. Pat. No. 6,144,276 describes a means of improving the cooling of planar transformers using cooling features integrally formed onto the windings themselves.

In general, a property of both coaxial and planar power transformer designs is the absence of significant leakage inductance; that is, that substantially all of the magnetic flux produced by the primary winding couples to the secondary winding. In some applications, however, the presence of transformer leakage inductance may be desirable. For example, transformer leakage inductance may function as a reactive element in associated circuitry, avoiding the need to add a physical inductor element to perform the equivalent function. U.S. Pat. No. 6,084,499 depicts a high leakage planar magnetic structure having decoupled windings on opposite poles of a common core. The structure has the relatively thin profile and large, flat surface areas typical of a planar core transformer design. The windings, however, are not enclosed entirely within core material, but rather communicate substantially with open air space. No specific cooling means of cooling the structure is described.

U.S. Pat. No. 4,845,606 describes a low leakage transformer design utilizing multiple core elements arranged in a matrix configuration and interwired to function collectively as a transformer. The matrix configuration is described as flat and essentially open in construction, and that cooling of the structure is therefore readily accomplished. The matrix transformer is said to be particularly suited to applications requiring high equivalent turns ratios and high dielectric isolations.

Given the continually increasing demands on power conversion equipment to operate more efficiently and at higher power levels, a configuration permitting improved heat extraction from electromagnetic elements, such as power transformers, would be desirable. It would be further desirable if the improved cooling could be accomplished while retaining a compact and efficient design. It would also be desirable if the improved design accommodated a means of providing for selected values of leakage inductance while minimizing power losses. It would also be desirable if the configuration accommodated a means of actively adjusting leakage inductance so as to provide optimal power sharing among devices operating in parallel or series.

SUMMARY OF THE INVENTION

This invention relates to an electromagnetic device having a configuration that permits improved heat extraction from the device while retaining efficient electromagnetic performance. The invention also relates to electrical power supply equipment that incorporates electromagnetic devices having a configuration that permits improved heat extraction.

The invention provides an electromagnetic device having at least two tubular magnetic core sections spaced apart in substantially parallel alignment. The tubular core sections are formed of a high permeability magnetic material and are substantially closed and hollow in cross section. The windings of the device are substantially disposed within and electrically insulated from the hollow portions of each tubular core section, such that a turn of a winding passes first through the hollow portion of one core section and then returns through the hollow portion of the other core section. In this configuration, good electromagnetic coupling can be achieved in a compact design while leaving the outer surfaces of the separate magnetic core sections unobstructed and available for heat extraction, which may be by conductive, convective, or other means. The tubular core sections may be elongated relative to the cross-sectional dimensions of the cores in order to increase the surface area available for cooling. The core sections of the invention may be continuous tubular structures, or may be constructed of multiple hollow or open core segments.

Cooling of the device provided by this invention may be enhanced by supplying heat conductive elements, such as cooling fins, in contact with the outer surfaces of the magnetic core sections of the device. In one embodiment, the device comprises two tubular magnetic core sections, and a cooling fin structure is provided in contact with the core sections as well as a heat sink. In cross section, the cooling fin structure has the shape of an "E," and the magnetic core sections are of rectangular shape and nested within the two respective semi-enclosed portions of the E-shaped cooling fin structure. Thus, each tubular magnetic core section is contacted on three sides of its rectangular cross section by conductive cooling surfaces. The cooling fins are constructed of a material with high thermal conductivity and may be electrically isolated from the core sections.

The electromagnetic device provided by this invention may be a transformer having primary and secondary windings. In this embodiment, both the primary and secondary windings pass through the hollow portion of one tubular magnetic core section and return through the hollow portion of at least one other tubular core section. The primary and secondary windings may be segregated into separate regions of the hollow portions of the respective core sections. Alternatively, the primary and secondary windings may be intertwined to promote electromagnetic coupling, provided they are electrically insulated from each other.

In certain embodiments of the invention, portions of the windings of the device may extend beyond the confines of the hollow magnetic core sections, as where for example the path of a winding loop transitions from the hollow portion of one core section to that of another. Alternatively, additional core segments may be added to enclose the otherwise exposed portions of the windings in part or in whole. For example, in an embodiment having two straight tubular core sections, additional hollow or open core segments may be provided to connect the two sections at one end, forming a single "U" shaped tubular core. The device may also comprise more than two tubular magnetic core sections, wherein the windings of the device pass through the hollow portion of each core section in succession. In these embodiments, additional cooling structures may be provided between the multiple core sections to enhance heat extraction.

The invention also accommodates a means of providing for selected values of leakage inductance associated with the device. In one embodiment, the magnetic core sections of the invention comprise high permeability opposing projections extending inward from the tubular side walls of the cores. By adjusting the dimensions of these projections, selected values of leakage inductance may be realized. In these embodiments, it is preferable that primary and secondary windings of the device occupy separate regions of the hollow portion of the core sections on opposite sides of the space between the opposing projections. This may be facilitated by providing a non-magnetic, electrically insulating material in the space between the opposing projections, i.e., between the primary and secondary windings. This has the further advantage of substantially confining the leakage flux to a path that minimizes leakage currents occurring in the windings that would generate additional power losses.

The invention also accommodates a means of actively adjusting the leakage inductance of the device. In one embodiment, an inductance tuning bar is provided in the vicinity of the region where the windings of the device protrude beyond the ends of the tubular core sections. The longitudinal dimension of the tuning bar is aligned with the plane of the windings and oriented transversely to the longitudinal direction of the tubular cores. A means of translating the bar is provided so that the distance from the bar to the ends of the tubular core sections, and its proximity to the windings, may be adjusted. By so translating the tuning bar, the leakage inductance of the device may be adjusted. In this way, minor deviations in the leakage inductance of the device from the desired value, due for example to slight variations in the positions of the windings within the cores, may be corrected.

Embodiments of the invention may include a plurality of dual- or multiple-core electromagnetic devices as described herein, arrayed in parallel or series. In these embodiments, any or all of the individual devices may comprise means of actively adjusting the leakage inductance of the device. In this way, leakage inductance may be tuned for optimal power sharing among the devices, as for example in an application requiring multiphase power conversion.

Additional features, embodiments, and advantages of the invention will become apparent from the description which follows, and may be realized by means of the instrumentalities and combinations particularly pointed out in the appended claims.

DETAILED DESCRIPTION

Figure 1:
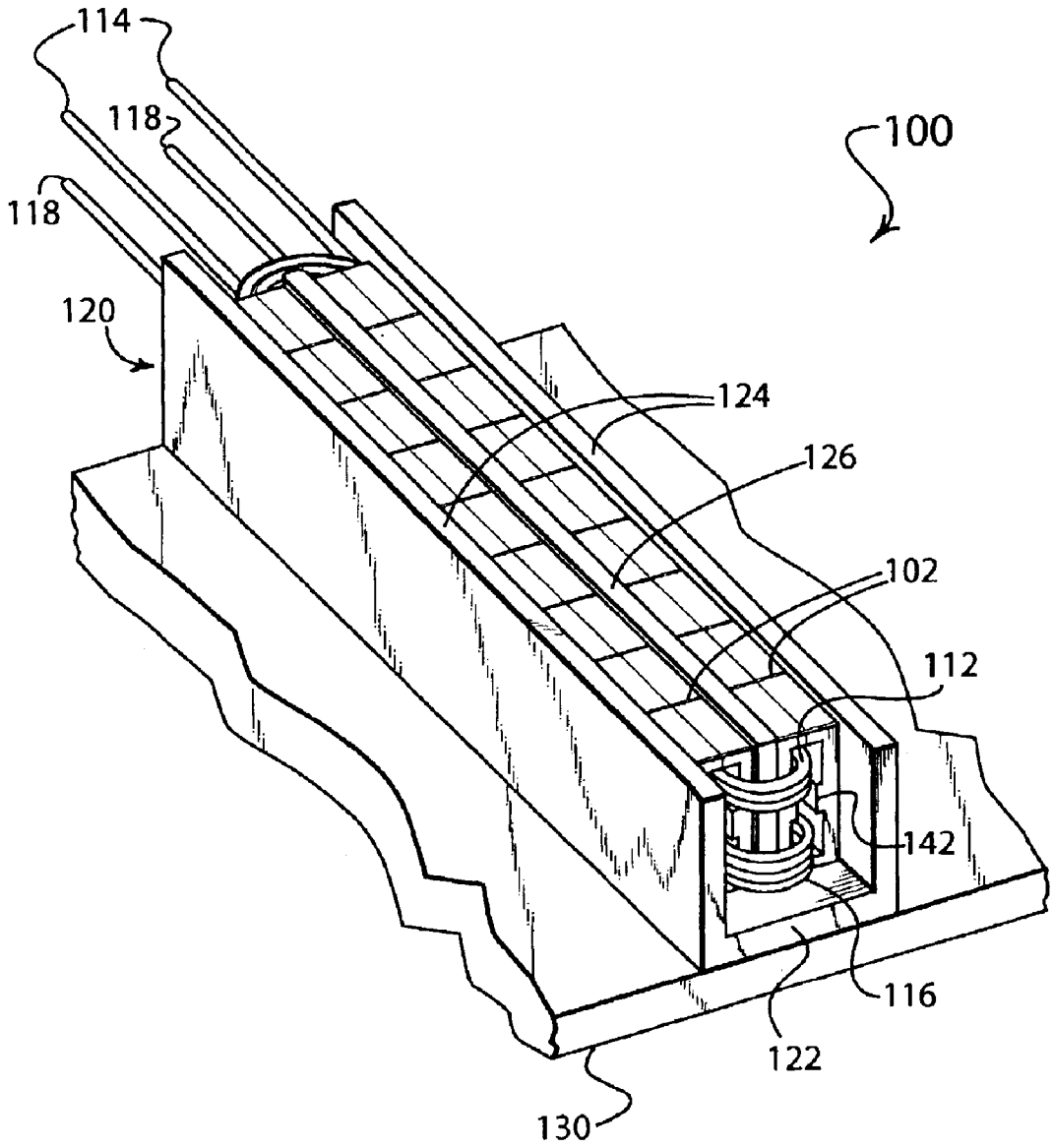
FIG. 1 is an isometric view of a transformer device constructed in accordance with the present invention.
Figure 2:
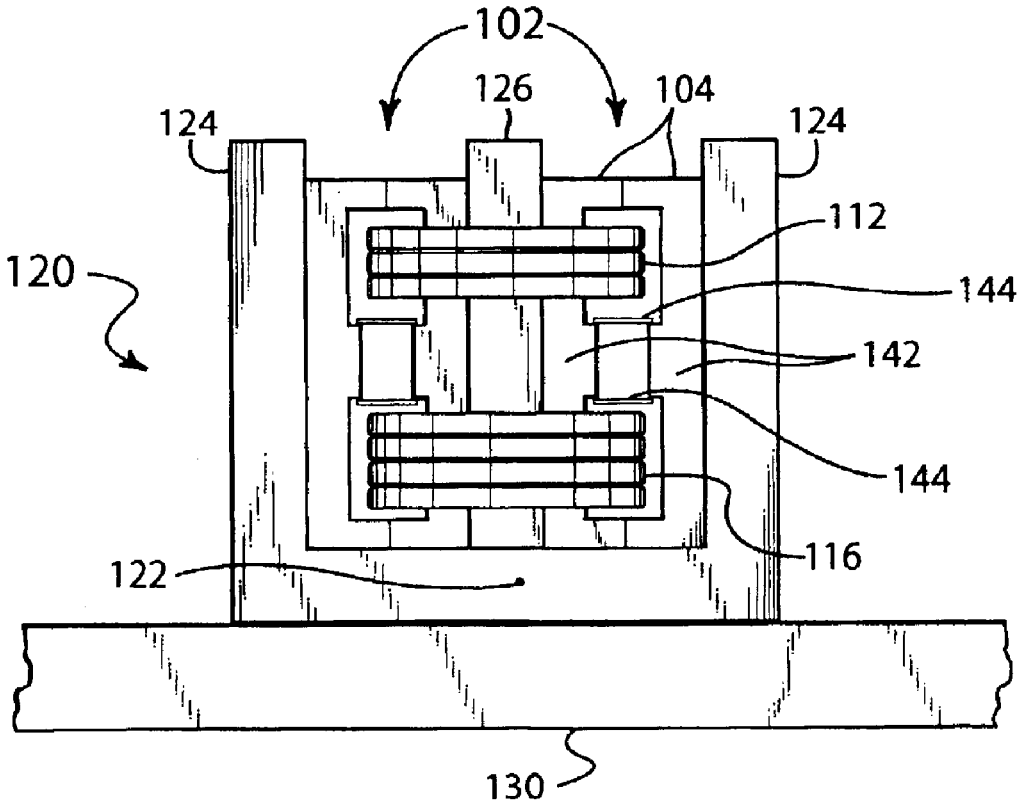
FIG. 2 is an end view of the transformer device illustrated in FIG. 1.
Figure 3:
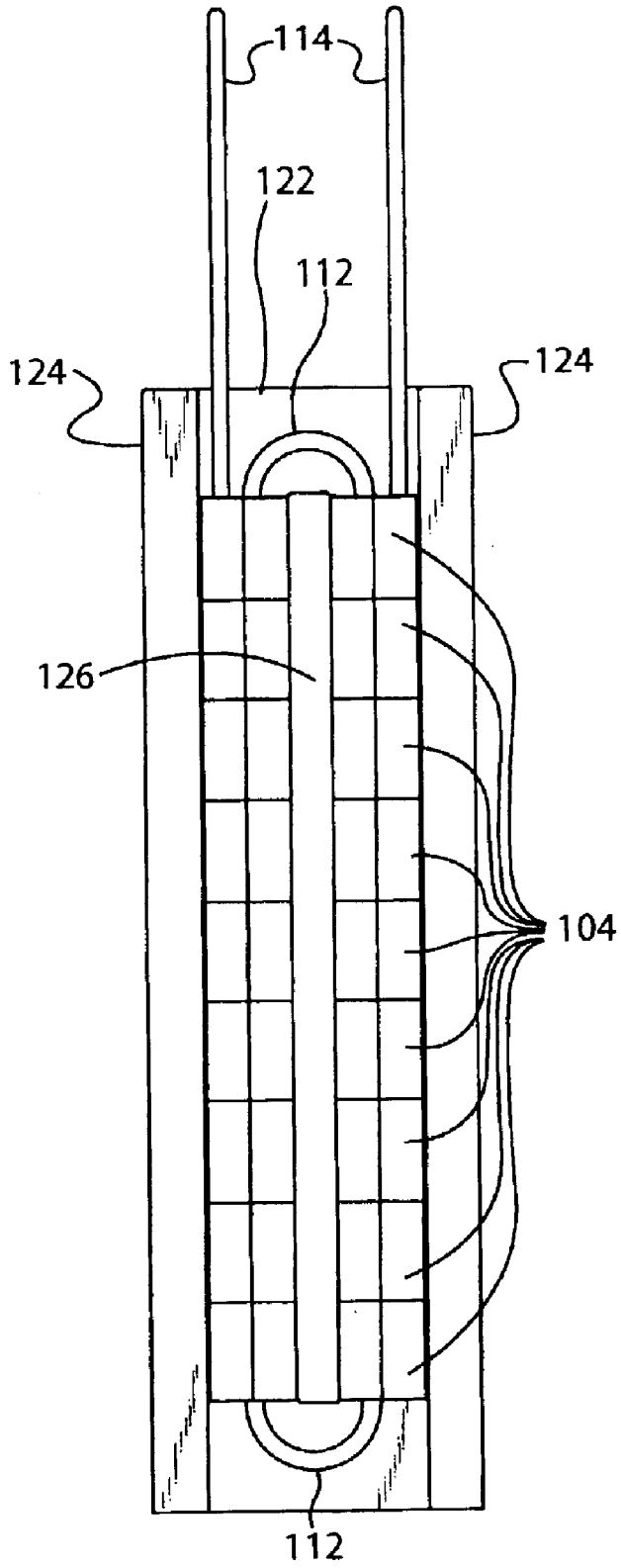
FIG. 3 is a top view of the transformer device illustrated in FIG. 1.

FIGS. 1–3 depict an embodiment of a parallel core transformer in accordance with the present invention. The transformer 100 includes two tubular magnetic core sections 102 in parallel alignment. Disposed within the magnetic core sections are primary windings 112 having primary connection leads 114, and secondary windings 116 having secondary connection leads 118. The core sections are elongated relative to their cross-sectional dimensions so that most of the winding lengths are contained within the core volumes. The core sections are spaced apart so that all outer surfaces of the cores are exposed and available for communication with a heat extraction means.

A conduction cooling assembly 120 is provided for heat extraction from the transformer elements. The cooling assembly comprises a baseplate section 122, two outer cooling fins 124, and a center cooling fin 126. Each magnetic core section 102 contacts a portion of the baseplate section 122, one side of the center cooling fin 126, and one side of one of the two outer cooling fins 124. The cooling assembly elements are constructed of a material with a high thermal conductivity, such as aluminum or copper. The cooling assembly elements may be electrically isolated from the core sections by providing dielectric materials between the cooling assembly and core surfaces in order to minimize eddy current losses. The baseplate 122 of the cooling assembly 120 is disposed in contact with a heat sink apparatus 130, such as a chill plate, either directly or through a thermally conductive interface material. Alternatively, the baseplate 122 or outer cooling fins 124 may themselves be elements of a heat sink apparatus. As further alternatives, any or all of the baseplate 122 or outer cooling fin 124 elements may be convectively cooled, or in thermal communication with additional heat extraction structures such as cooling pipes or heat exchangers (not shown).

The core sections 102 are rectangular in cross section, which provides flat surfaces for contact with the cooling assembly baseplate 122 and fins 124, 126. Alternatively, the core sections may have any cross-sectional shape that makes substantial conformal contact with the heat extraction means provided. The tubular core sections 102 are formed of a high permeability magnetic material and are substantially closed in cross section to provide a low reluctance path for magnetic flux. For a transformer embodiment, the core material preferably has a relative permeability greater than 1000. By providing core sections having a rectangular aspect ratio in cross section, the hollow interior space 104 of the core sections can accommodate segregated primary 112 and secondary 116 windings within a minimum of volume.

While a transformer embodiment of the invention is illustrated in FIGS. 1–3 having both primary and secondary windings, it will be readily appreciated that an inductor embodiment may be constructed in accordance with the invention by omitting the secondary winding.

Extending inward from the tubular side walls of the core sections 102 are opposing projections 142 which provide leakage inductance associated with the transformer device. The dimensions of these projections may be adjusted in order to achieve a selected value of leakage inductance. Alternatively, the projections 142 may be omitted. In the illustrated embodiment, strips 144 of a non-magnetic insulating material, such as Nomex®, are provided on either side of the space between the opposing projections 142. The strips 144 prevent the primary and secondary windings from entering the space between the projections 142 and thereby minimize losses that would occur from currents generated in the windings due to leakage flux.

Each of the tubular magnetic core sections 102 is comprised of a plurality of core segments 104. The core segments 104 are disposed in pairs and assembled in longitudinal alignment to form the tubular core sections. Referring to FIG. 2, each individual core segment has an "E" shape in cross section, with the center leg of the "E" being one of the opposing projections 142 that extend inward from the side walls of the core sections. Preferably, core segments are disposed without intervening gaps to form the core sections so as to maximize the core volume, although gaps between core segments may be provided. Tubular core sections may alternatively be of solid construction, although segments of the type illustrated are more likely to have ready commercial availability.

In constructing the device of this embodiment, it may be necessary to provide gaps between the magnetic core sections 102 and the cooling fins 124, 126 due to mechanical tolerances. These gaps may be filled with a potting compound, i.e., a thermally conductive compressible interface material or flowable thermal interface compound between the core sections and the cooling plate or heat sink. Potting of the transformer may be facilitated by adding a cover plate (not shown) to the surface of the transformer opposite the baseplate 122, and by adding an end plate to one side of the transformer, so as to contain the liquid potting compound before it is cured.

Alternatively, the fins are sandwiched between core pieces, and a clamping mechanism holds the assembly together. For example, the outer pair of fins may extend beyond the cores and have a set of bolts to provide a clamping force. The assembly is then attached to a cooling plate or heat sink thorough an additional clamping structure such as an additional plate on the opposite side of the transformer as the cooling plate. A structure with discrete fins has the reduced thermal resistance between the cores and fins, but the thermal resistance between the fins and the cooling plate or heat sink is increased. Increasing the width of the cooling fins will reduce the thermal resistance between the fins and the cooling plate or heat sink.

The windings 112, 116 are disposed along the longitudinal axis of and within the hollow inner space of each of the tubular magnetic core sections 102 in succession. In completing this path, exposed portions of the windings remain that are not enclosed within either of the core sections. Preferably, these exposed winding portions comprise a small fraction of the winding lengths. Alternatively, additional core segments may be added to enclose the otherwise exposed winding portions in part or in whole. For example, additional hollow or open core segments could be provided to connect the two core sections at one end, forming a single "U" shaped tubular core.

The primary and secondary winding leads 114 and 118 project from one longitudinal end of the transformer device. Alternatively, winding leads could project from opposing ends of the device as power connection needs may warrant. As a further alternative, winding leads could project from gaps in either of the tubular core sections.

A device according to the invention may be constructed having more than two tubular core sections in substantially parallel alignment, with the windings of the device disposed through the hollow portions of each core section in succession. Having a greater number of core sections may serve to increase further the available surface area for cooling. In general, however, having a larger number core sections will result in additional exposed portions of the windings, which will tend to reduce the electromagnetic efficiency of the device if end cap core segments are not provided.

In operation, current is provided at a voltage to the primary winding 112 through the primary winding leads 114. Through magnetic induction, current is produced at a voltage in the secondary winding 116. The coupling of current from the primary to the secondary is enhanced by the magnetic core sections 102. Leakage inductance developed in the transformer device is enhanced by the presence of opposing projections 142 in the core sections. Through secondary winding leads 118, power may be delivered to a load (not shown). Heat developed in the windings 112, 116 and core sections 102 is conducted away from the surfaces of the core sections in contact with the cooling assembly 120, through the cooling fins 124, 126 and baseplate 122, and to a heat sink apparatus 130. It has been observed that a transformer apparatus of the type illustrated is capable of providing significantly higher power throughput than a conventional transformer of equivalent volume, with substantially lower operating temperatures.

A power supply or power conversion device according to the invention incorporates one or more electromagnetic devices as described herein. In one embodiment, a DC power supply has an inverter section comprising switches, a parallel core power transformer, and resonant circuit elements. The parallel core power transformer comprises a plurality of tubular magnetic core sections in parallel alignment, with primary and secondary windings disposed therein. The switches operate alternately to generate an AC voltage across the primary winding of the transformer. The resonant circuit elements, such as capacitors, together with leakage inductance of the transformer, form a resonant circuit topology. A rectifier circuit is provided to convert the AC output at the secondary winding of the transformer to a filtered DC output. Examples of the operation and characteristics of power supplies in which the electromagnetic devices of this invention may be utilized are described in U.S. Pat. No. 5,535,906, incorporated herein by reference.

It will be appreciated by those of skill in the art that the materials, dimensions, and gauges of the core sections and windings will be chosen depending upon factors such as the frequency and power levels at which the apparatus is to operate. For example, the thickness of the walls of the tubular core sections 102, and the proportion of the hollow inner area to the core cross sectional area, will be chosen depending upon the flux capability needed and the thermal conductivity of the core material. The lengths of the core sections as compared to their cross section dimensions will be chosen depending upon the surface area needed for heat extraction compared to the losses that result due to lengthening of the winding paths.

Figure 4:
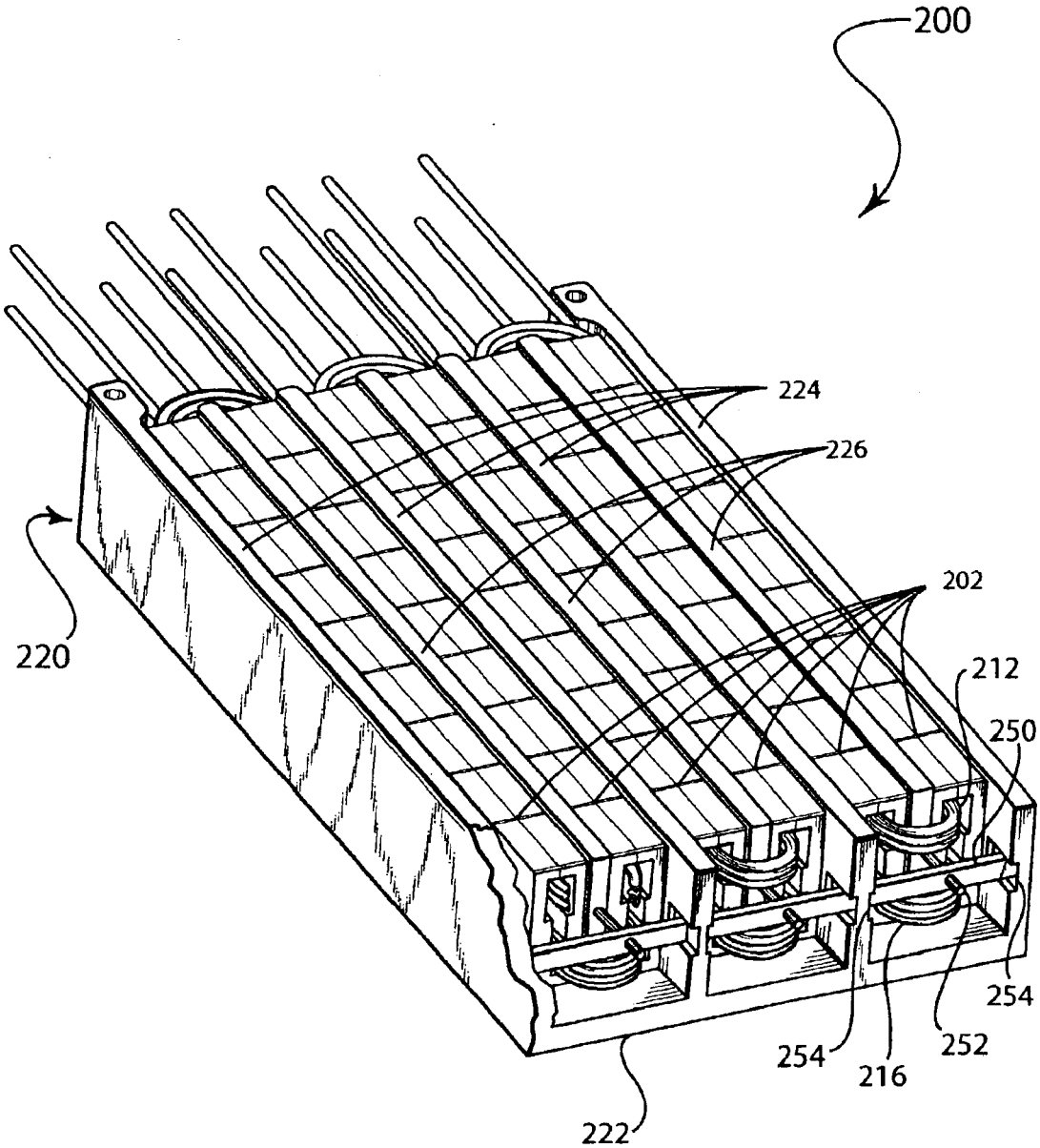
FIG. 4 illustrates a three-phase transformer assembly constructed in accordance with the present invention.
Figure 5:
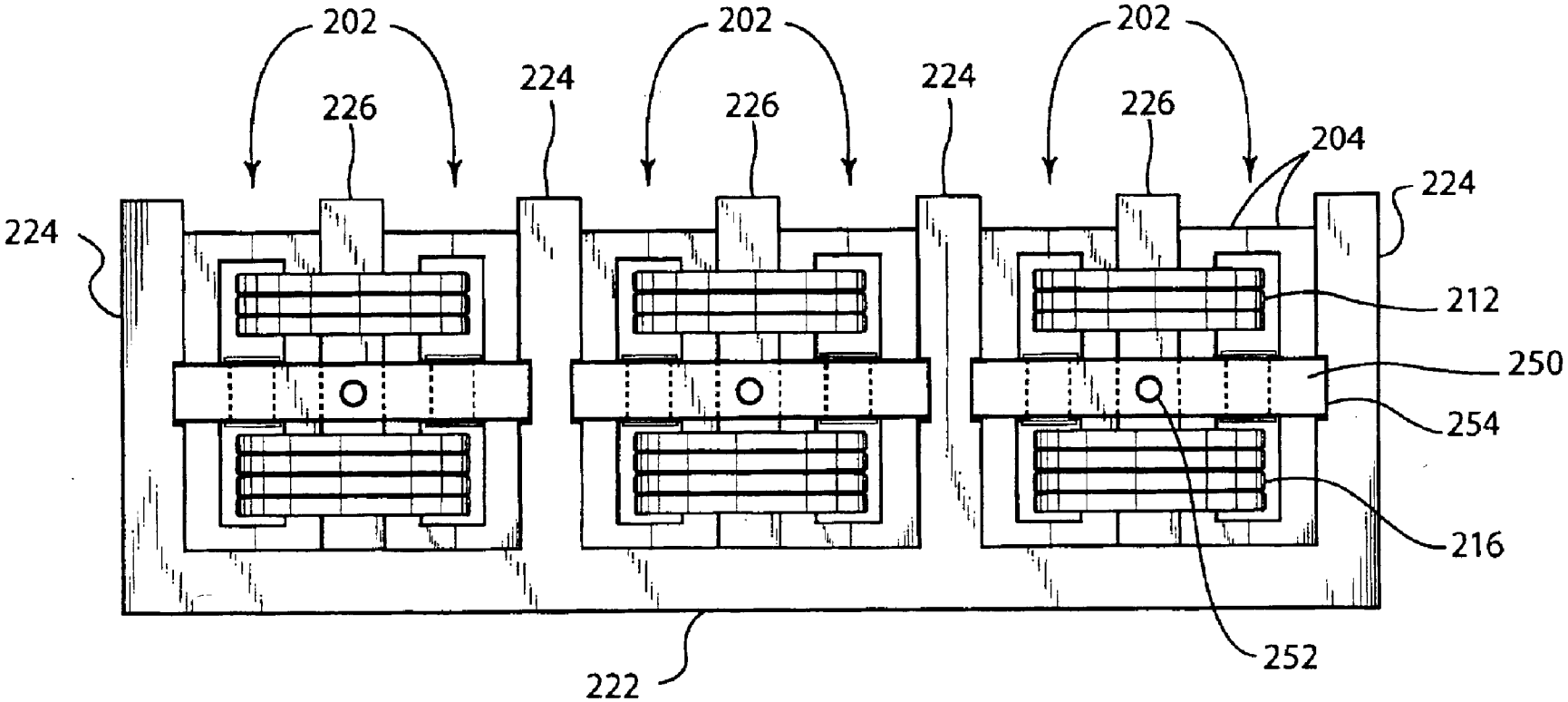
FIG. 5 is an end view of the three-phase transformer assembly illustrated in FIG. 4.
Figure 6:
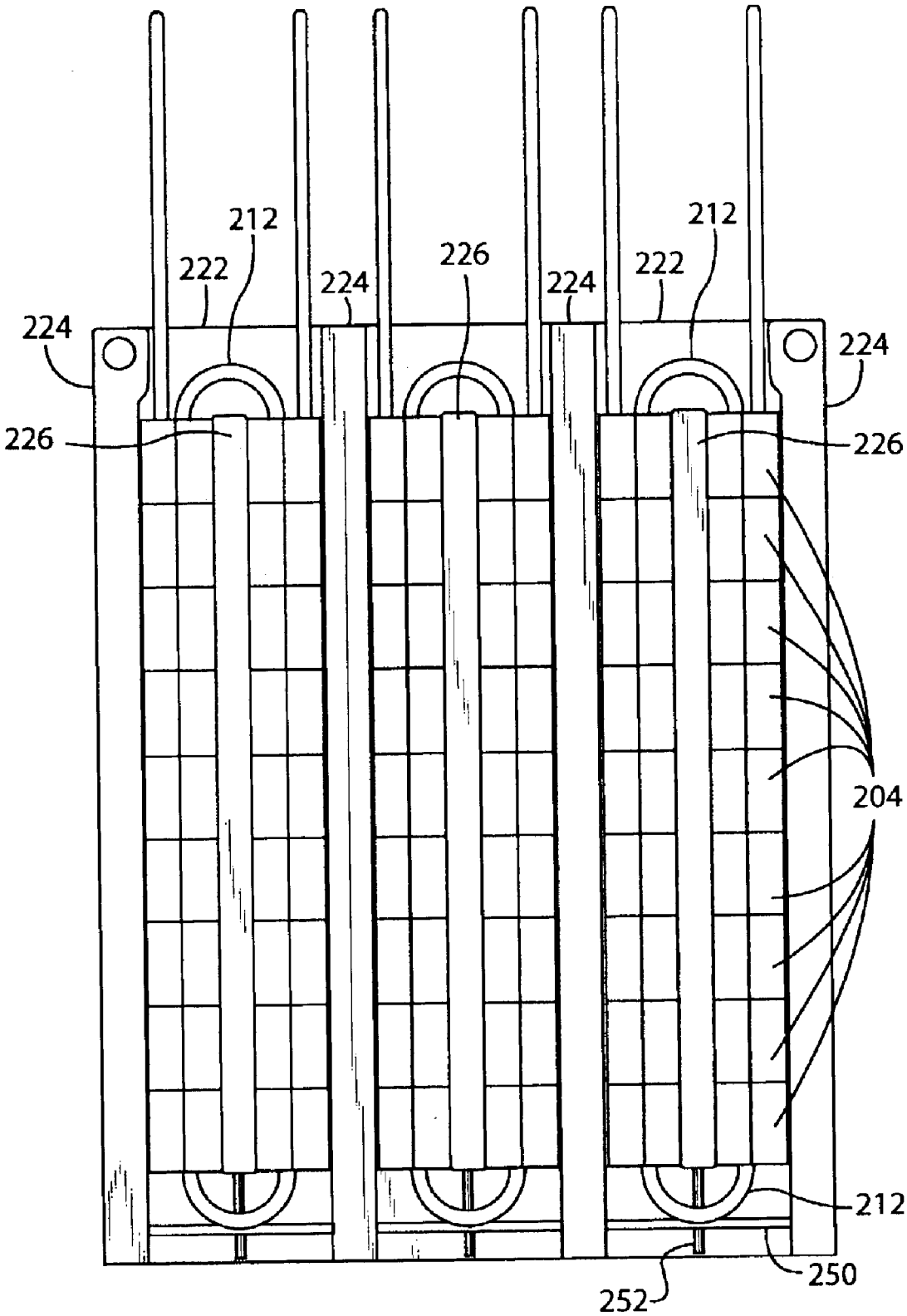
FIG. 6 is a top view of the three-phase transformer assembly illustrated in FIG. 4.

FIGS. 4–6 depict an embodiment of a three-phase parallel core transformer assembly in accordance with the invention. The three-phase transformer 200 includes three pairs of tubular magnetic core sections 202, all in parallel alignment. Primary 212 and secondary 216 windings are disposed within each pair of adjacent magnetic cores sections 202. Three transformer devices are thus formed, one being available for each phase of a three-phase power supply. Opposing projections of magnetic core material 242 are provided on the interior side walls of the core sections 202 for enhancement of leakage inductance of the transformer devices.

A conduction cooling assembly 220 constructed of a material with a high thermal conductivity is provided for heat extraction from the transformer elements. The cooling assembly comprises a baseplate section 222, three intra-winding cooling fins 226, and four extra-winding cooling fins 224. Each of the six magnetic core sections 202 is disposed in contact with the baseplate section 222, a extra-winding cooling fin 224 and a intra-winding cooling fin 226 such that heat is conducted from the surfaces of the cores, through the cooling assembly elements, to a heat sink apparatus (not shown). Alternatively, the heat sink apparatus may be attached to the side of the transformer opposite to baseplate 222 such that the heat flows through the ends of the fins into the heat sink apparatus. The fins may have threaded holes to allow attachment to the heat sink apparatus with screws.

An inductance tuning bar 250 is provided for each of the three transformer devices of the three-phase transformer. Each tuning bar 250 is disposed at the longitudinal ends of each pair of tubular core sections between an exposed portion of the primary winding 212 and an exposed portion of the secondary winding 216. The longitudinal dimension of the tuning bar is aligned with the plane of the windings and oriented transversely to the longitudinal axes of the tubular cores. A translation screw 252 is rotatably connected to the tuning bar 250 and threaded into the body of the intra-winding cooling fin 226 of the respective transformer device. The longitudinal ends of the tuning bar are disposed within slots 254 in each extra-winding cooling fin of the transformer device. By operating the translation screw 252, the distance from the tuning bar 250 to the ends of the tubular core sections 202, and the proximity of the tuning bar to the windings 212, 216, may be adjusted.

In order to prevent excessive power losses in the inductance tuning bar 250, it should preferably be made of a non-magnetic material with high electrical conductivity such as brass, copper or aluminum. The inductance tuning bar could also be made from a low-loss magnetic material such as ferrite.

In operation, each of the three transformer devices formed by an adjacent pair of magnetic core sections 202 and associated windings 212, 216 converts power from one phase of a three-phase power supply. Heat is extracted from the magnetic core surfaces through the cooling assembly 220. Leakage inductance associated with each transformer device is developed, as enhanced by the opposing projections 242 in the tubular magnetic cores. By operating the translation screw 252 of a transformer device, the leakage inductance of that device may be adjusted. In this way, minor deviations in the leakage inductance of the device from a desired value, due for example to slight variations in the positions of the windings within the cores, may be corrected. Thus, the leakage inductances of each of the three transformer devices of the three-phase transformer may be tuned for optimal power sharing among the devices.

Although the invention has been described in connection with specific embodiments thereof, many alternative embodiments and equivalents will be apparent to those of skill in the art. Accordingly, the invention is intended to embrace all such alternatives and equivalents that fall within the spirit and scope of the appended claims.

What is claimed is:

1. An electromagnetic device, comprising:

a) A first tubular magnetic core section;

b) A second tubular magnetic core section spaced apart from and in substantially parallel alignment with the first tubular magnetic core section;

c) A primary conductive winding, wherein a first portion of the primary conductive winding is disposed within the first tubular magnetic core section and a second portion of the primary conductive winding is disposed within the second tubular magnetic core section; and d) A heat extraction means in communication with at least a portion of the outer surface of the first tubular magnetic core section and at least a portion of the outer surface of the second tubular magnetic core section.

2. The electromagnetic device of claim 1, wherein the heat extraction means comprises a conduction cooling assembly.

3. The electromagnetic device of claim 2, wherein the conduction cooling assembly comprises a conductive baseplate in thermal communication with the first and second tubular magnetic core sections, a center conductive cooling fin disposed in the space between and in thermal communication with the first and second tubular magnetic core sections, a first outer cooling fin in thermal communication with the first tubular magnetic core section and a second outer cooling fin in thermal communication with the second tubular magnetic core section.

4. The electromagnetic device of claim 3, wherein the conductive baseplate, center conductive cooling fin, first outer cooling fin, and second outer cooling fin are in direct thermal contact with the first and second tubular magnetic core sections.

5. An electromagnetic device, comprising:

a) A first tubular magnetic core section;

b) A second tubular magnetic core section spaced apart from and in substantially parallel alignment with the first tubular magnetic core section;

c) A primary conductive winding, wherein a first portion of the primary conductive winding is disposed within the first tubular magnetic core section and a second portion of the primary conductive winding is disposed within the second tubular magnetic core section;

d) A secondary conductive winding, wherein a first portion of the secondary conductive winding is disposed within the first tubular magnetic core section and a second portion of the secondary conductive winding is disposed within the second tubular magnetic core section; and e) A heat extraction means in communication with at least a portion of the outer surface of the first tubular magnetic core section and at least a portion of the outer surface of the second tubular magnetic core section.

6. The electromagnetic device of claim 5, wherein the first and second tubular magnetic core sections are rectangular in cross section.

7. The electromagnetic device of claim 5, wherein the first and second tubular magnetic core sections are elongated relative to their cross sectional dimensions.

8. The electromagnetic device of claim 5, wherein the first and second tubular magnetic core sections are composed of a ferrite material.

9. The electromagnetic device of claim 5, wherein the heat extraction means comprises a conduction cooling assembly.

10. The electromagnetic device of claim 9, wherein the conduction cooling assembly comprises a conductive baseplate in thermal communication with the first and second tubular magnetic core sections, and a center conductive cooling fin disposed in the space between and in thermal communication with the first and second tubular magnetic core sections.

11. The electromagnetic device of claim 10, wherein the conduction cooling assembly further comprises a first outer cooling fin in thermal communication with the first tubular magnetic core section and a second outer cooling fin in thermal communication with the second tubular magnetic core section.

12. The electromagnetic device of claim 11, wherein the conductive baseplate, center conductive cooling fin, first outer cooling fin, and second outer cooling fin are in direct thermal contact with the first and second tubular magnetic core sections.

13. The electromagnetic device of claim 9, wherein the conduction cooling assembly is composed of a thermally conductive material.

14. The electromagnetic device of claim 13, wherein the material is aluminum.

15. The electromagnetic device of claim 5, wherein the first and second tubular magnetic core sections each comprise opposing projections extending inward from the side walls of the first and second tubular magnetic core sections, the opposing projections enhancing the leakage inductance of the device and forming a gap space within each of the first and second tubular magnetic core sections.

16. The electromagnetic device of claim 15, wherein the primary conductive winding and secondary conductive winding are separated from the gap space within each of the first and second tubular magnetic core sections by insulating strips.

17. The electromagnetic device of claim 5, further comprising an inductance tuning bar disposed at the longitudinal ends of the first and second tubular magnetic core sections.

18. The electromagnetic device of claim 17, wherein the inductance tuning bar is disposed between an exposed portion of the primary conductive winding and an exposed portion of the secondary conductive winding, and oriented transversely to the longitudinal axes of the first and second tubular magnetic core sections.

19. The electromagnetic device of claim 11, further comprising an inductance tuning bar disposed at the longitudinal ends of the first and second tubular magnetic core sections.

20. The electromagnetic device of claim 19, wherein the distance from the inductance tuning bar to the first and second tubular magnetic core sections is adjustable.

21. The electromagnetic device of claim 20, further comprising a translation screw threaded into the center cooling fin and rotatably connected to the inductance tuning bar, wherein the inductance tuning bar is slidably disposed within slots formed in each of the first and second outer cooling fins, and wherein the distance from the inductance tuning bar to the first and second tubular magnetic core sections is adjusted by operation of the translation screw.

22. A three-phase transformer, comprising:

First, second, and third electromagnetic assemblies, each comprising:

a) A first tubular magnetic core section;

b) A second tubular magnetic core section spaced apart from and in substantially parallel alignment with the first tubular magnetic core section;

c) A primary conductive winding, wherein a first portion of the primary conductive winding is disposed within the first tubular magnetic core section and a second portion of the primary conductive winding is disposed within the second tubular magnetic core section;

d) A secondary conductive winding, wherein a first portion of the secondary conductive winding is disposed within the first tubular magnetic core section and a second portion of the secondary conductive winding is disposed within the second tubular magnetic core section;

Wherein the second tubular magnetic core section of the first electromagnetic assembly is spaced apart from and in substantially parallel alignment with the first tubular magnetic core section of the second electromagnetic assembly, and the second tubular magnetic core section of the second electromagnetic assembly is spaced apart from and in substantially parallel alignment with the first tubular magnetic core section of the third electromagnetic assembly.

23. The three-phase transformer of claim 22, further comprising a heat extraction means in communication with at least a portion of the outer surface of each tubular magnetic core section of each electromagnetic assembly.

24. The three-phase transformer of claim 23, wherein the heat extraction means comprises a conduction cooling assembly.

25. The three-phase transformer of claim 24, wherein the conduction cooling assembly comprises a conductive baseplate in thermal communication with each tubular magnetic core section of each electromagnetic assembly; and three intra-winding conductive cooling fins, each intra-winding cooling fin disposed in the space between and in thermal communication with the first and second tubular magnetic core sections of one of the three electromagnetic assemblies.

26. The three-phase transformer of claim 25, wherein the conduction cooling assembly further comprises four extra-winding cooling fins, wherein each tubular magnetic core section of each electromagnetic assembly is disposed in direct thermal contact with each of the baseplate, one intra-winding cooling fin, and one extra-winding cooling fin.

27. The three-phase transformer of claim 22, wherein the first and second tubular magnetic core sections of each electromagnetic assembly each comprise opposing projections extending inward from the side walls of the first and second tubular magnetic core sections, the opposing projections enhancing the leakage inductance of each electromagnetic assembly and forming a gap space within each of the first and second tubular magnetic core sections.

28. The three-phase transformer of claim 27, wherein each electromagnetic assembly further comprises an inductance tuning bar disposed at the longitudinal ends of the first and second tubular magnetic core sections of the electromagnetic assembly, and wherein the distance from the inductance tuning bar to the first and second tubular magnetic core sections of the electromagnetic assembly is adjustable.

29. A power supply device, comprising:

An electromagnetic assembly, comprising:

a) A first tubular magnetic core section;

b) A second tubular magnetic core section spaced apart from and in substantially parallel alignment with the first tubular magnetic core section;

c) A primary conductive winding, wherein a first portion of the primary conductive winding is disposed within the first tubular magnetic core section and a second portion of the primary conductive winding is disposed within the second tubular magnetic core section; and d) A heat extraction means in communication with at least a portion of the outer surface of the first tubular magnetic core section and at least a portion of the outer surface of the second tubular magnetic core section.

30. The power supply device of claim 29, wherein the heat extraction means comprises a conduction cooling assembly.

31. The power supply device of claim 30, wherein the conduction cooling assembly is in direct thermal contact with the first and second tubular magnetic core sections.

32. The power supply device of claim 29, further comprising a resonant circuit, and wherein the electromagnetic assembly has a leakage inductance that forms one element of the resonant circuit.

33. The power supply device of claim 32, further comprising an inductance tuning bar disposed at the longitudinal ends of the first and second tubular magnetic core sections.

* * * * *